US006122466A

United States Patent [19]

Aoki et al.

[11] Patent Number: 6,122,466

[45] Date of Patent: Sep. 19, 2000

[54] IMAGE FORMING APPARATUS

[75] Inventors: Fumitaka Aoki, Tokyo; Atsushi Hosoi, Moriya-machi, both of Japan

[73] Assignee: Canon Kabushiki Kaisha, Tokyo, Japan

[21] Appl. No.: 09/413,466

[22] Filed: Oct. 6, 1999

[30] Foreign Application Priority Data

Oct. 12, 1998 [JP] Japan ..... 10-289382
Oct. 4, 1999 [JP] Japan ..... 11-282908

[51] Int. Cl.[7] ..... G03G 15/00; G03G 21/16

[52] U.S. Cl. ..... 399/125

[58] Field of Search ..... 399/107, 108, 399/110, 125, 113, 258; 347/138, 152

[56] References Cited

U.S. PATENT DOCUMENTS 5,206,681 4/1993 Otomo et al. ..... 399/125 X
5,884,126 3/1999 Schoch et al. ..... 399/258

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

An image forming apparatus includes a lower structural body, an upper structural body turnable around a turning shaft between a closed position in which the upper structural body is closed with respect to the lower structural body and an opened position in which the upper structural body is opened upward with respect to the lower structural body, and a developing device which develops, with a developing agent, an electrostatic image formed on a photosensitive drum. The developing device is disposed inside the upper structural body and includes a developing roller rotatable around a rotating axis to bear and transport the developing agent to a developing position and a developing-agent container containing the developing agent. An axial direction of the rotating axis of the developing roller intersects with an axial direction of the turning shaft of the upper structural body. An angle by which the upper structural body is turned from the closed position to the opened position is not more than an angle of repose of the developing agent.

9 Claims, 5 Drawing Sheets

IMAGE FORMING APPARATUS

BACKGROUND OF THE INVENTION

1. Field of the Invention

The present invention relates to an image forming apparatus such as a copying machine or a printer of the electrophotographic type.

2. Description of Related Art

Electrophotographic-type image forming apparatuses using powdered developing agents (toners) are employed as the output apparatuses of computers or workstations. The image forming apparatus of this type is provided with a photosensitive drum for forming thereon an electrostatic latent image while the photosensitive drum is rotating, a developing device for supplying the developing agent to the electrostatic latent image formed on the photosensitive drum, and an image forming part for forming an image on a recording medium by transferring the developed image to the recording medium. The image forming apparatus generally further includes a paper feeding part arranged to send the recording medium (paper) to the image forming part, and a delivery part disposed on one side opposite to the paper feeding part across the image forming part. A recording medium transport path is thus formed to transport the recording medium from the paper feeding part toward the delivery part.

Generally, the recording medium transport path laterally extends as viewed from the front side of the image forming apparatus. The axis of a rotating shaft of the photosensitive drum extends almost perpendicularly to the recording medium transport path. Further, the developing device is provided with a developing roller for supplying the photosensitive drum with the developing agent. The developing agent is supplied to the photosensitive drum while the developing roller is rotating. The rotating shaft of the developing roller is arranged to extend approximately in parallel with the rotating shaft of the photosensitive drum. With these rotating shafts arranged to be approximately in parallel with each other, a uniform amount of the developing agent is supplied from the developing roller to the photosensitive drum.

Some of such image forming apparatuses are of a so-called clamshell type. The clamshell-type image forming apparatus has a turning shaft which is disposed at one end part thereof in the direction of orthogonally intersecting the recording medium transport path (a rear side part), and an opening-and-closing part which is disposed at the other end part (a front side part), in the orthogonally intersecting direction, opposite to the turning shaft. Thus, the body of the clamshell-type image forming apparatus is arranged to be able to be divided into an upper structural body and a lower structural body by opening and closing the opening-and-closing part. In the case of the clamshell-type image forming apparatus, the recording medium transport path can be exposed to a great degree by opening the opening-and-closing part. This facilitates trouble shooting work by the user in the event of, for example, jamming of paper.

In the clamshell-type electrophotographic image forming apparatus, it is general that the photosensitive drum and the developing device are disposed within the upper structural body and the cassette tray and the fixing device are disposed within the lower structural body. While the lower structural body is fixed, a front part of the upper structural body is arranged to be pushed upward by means of a damper which has air or the like sealed therein.

With the photosensitive drum and the developing device disposed inside the upper structural body of the clamshell-type image forming apparatus, when the upper structural body is turned upward, the photosensitive drum and the developing device slant accordingly. In this instance, the developing agent contained in the developing device tends to move downward to gather on one side accordingly as the developing device slants. The one-sided gathering of the developing agent tends to cause the amount of the developing agent, which is supplied from the developing roller to the photosensitive drum, to be supplied unevenly in the axial direction of the rotating shaft of the developing roller. Such an uneven supply of the developing agent causes the developed image on the drum to have uneven density and thus eventually lowers the quality of an image formed on the recording medium.

BRIEF SUMMARY OF THE INVENTION

In view of the above described, it is an object of the invention to provide an image forming apparatus capable of preventing an image quality from lowering due to the one-sided gathering of a developing agent.

To attain the above object, in accordance with an aspect of the invention, there is provided an image forming apparatus, comprising a first casing, a second casing turnable around a turning shaft between a closed position in which the second casing is closed with respect to the first casing and an opened position in which the second casing is opened upward with respect to the first casing, and a developing device which develops, with a developing agent, an electrostatic image formed on an image bearing member, the developing device being disposed inside the second casing and comprising a developing-agent bearing member rotatable around a rotating axis to bear and transport the developing agent to a developing position and a developing-agent container containing the developing agent, an axial direction of the rotating axis of the developing-agent bearing member intersecting with an axial direction of the turning shaft of the second casing, wherein an angle by which the second casing is turned from the closed position to the opened position is not more than an angle of repose of the developing agent.

The above and further objects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

Figure 1:
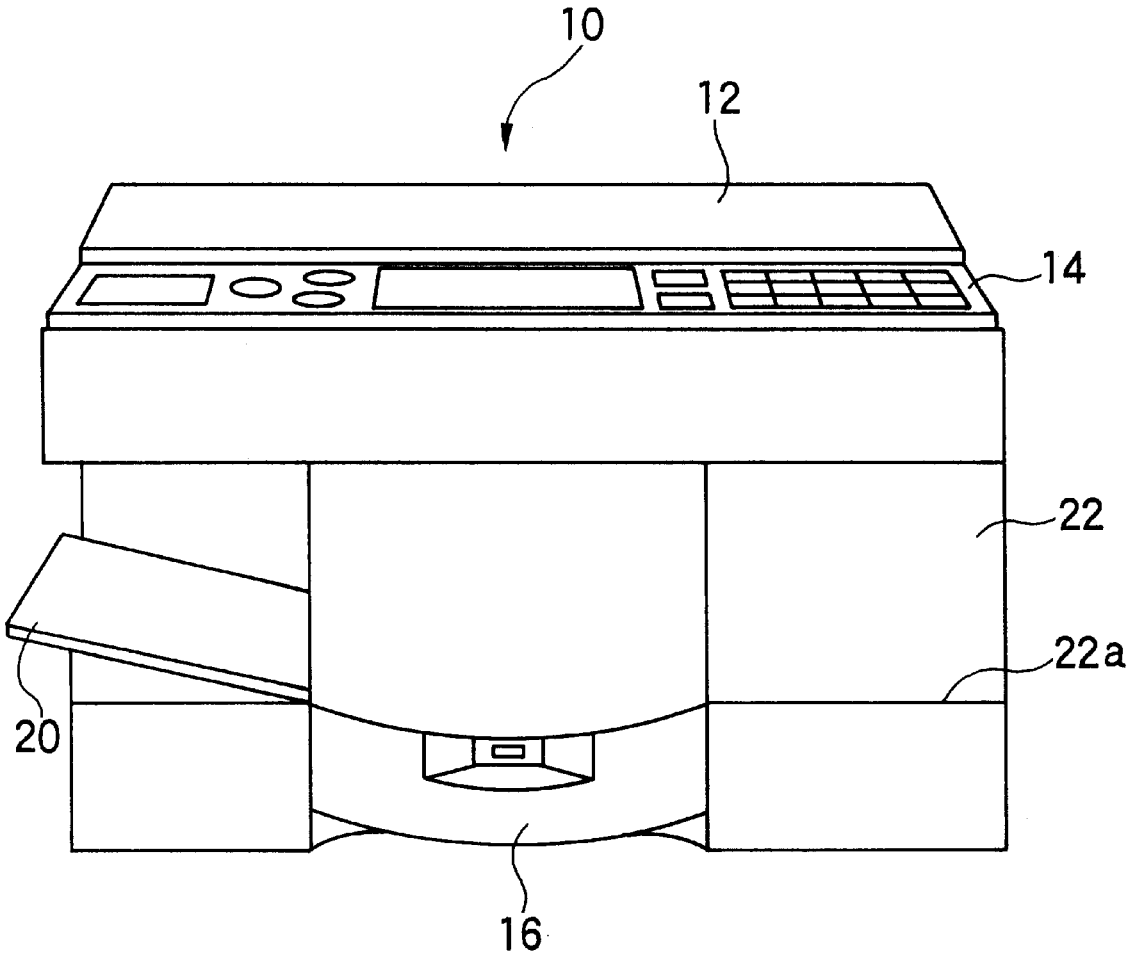
FIG. 1 is a perspective view showing the appearance of a copying machine which is an example of image forming apparatus according to an embodiment of the invention.

FIG. 1 shows in a perspective view the appearance of a copying machine which is an example of image forming apparatus according to an embodiment of the invention.

Figure 2:
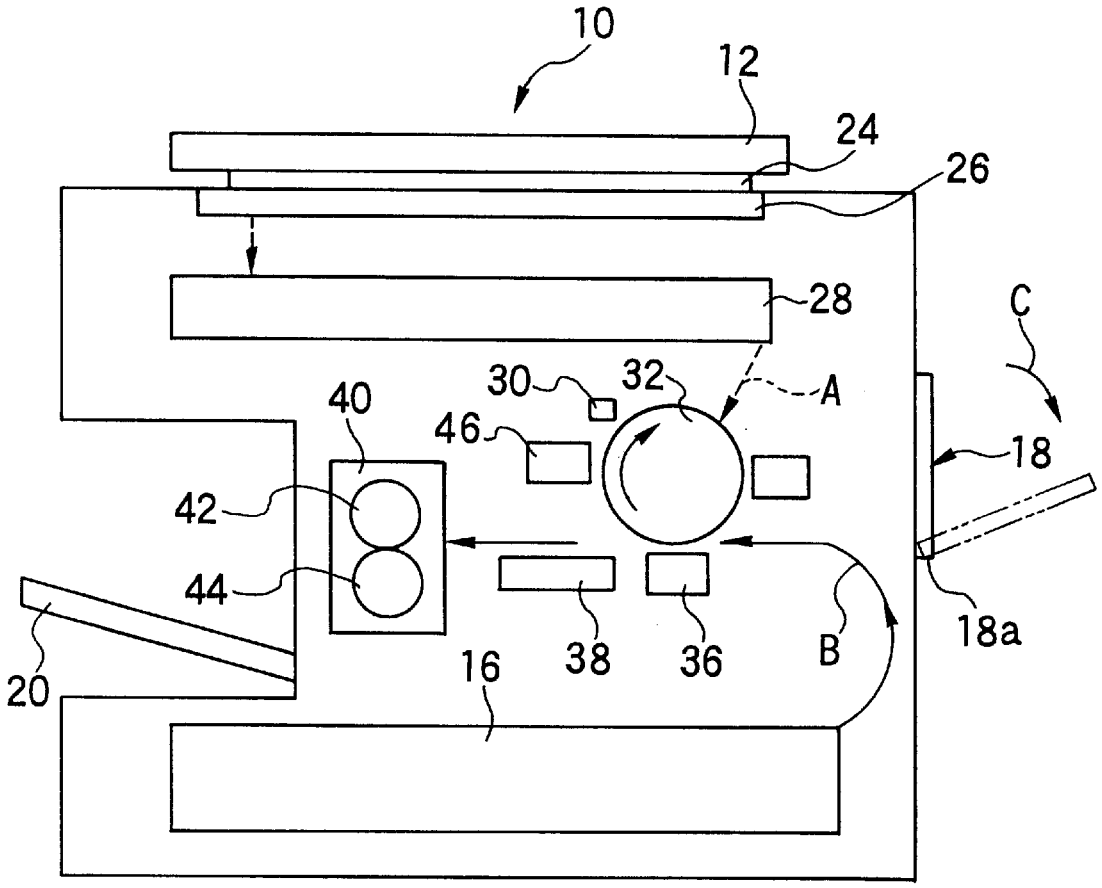
FIG. 2 is a schematic view showing the internal arrangement of the copying machine shown in FIG. 1.

Referring to FIG. 1, a copying machine 10, which is arranged by way of example as an image forming apparatus according to the invention, is provided with an original pressing plate 12. The original pressing plate 12 is disposed on the top of the copying machine 10 to be openable and closable. An operation panel display part 14 is disposed on the front side of the top of the copying machine 10 to allow information on the number of copy sheets, etc., to be inputted. A universal cassette 16 which is arranged to contain a plurality of cut paper sheets therein is provided to be inserted into and taken out from the front side of the body of the copying machine 10. A manual feed tray 18 of a rectangular shape (see FIG. 2) is provided on the right side wall of the copying machine 10 to allow manual feeding of small-sized recording papers such as post cards. As shown in FIG. 2, the manual feed tray 18 is arranged to be turnable around its lower side part 18*a* in the direction of an arrow C and thus to be openable to a position indicated with a two-dot chain line where the small-sized recording medium (paper) can be placed thereon. A paper delivery tray 20 is provided at the left side wall of the copying machine 10 for placing each recording paper having an image formed thereon.

Figure 3:
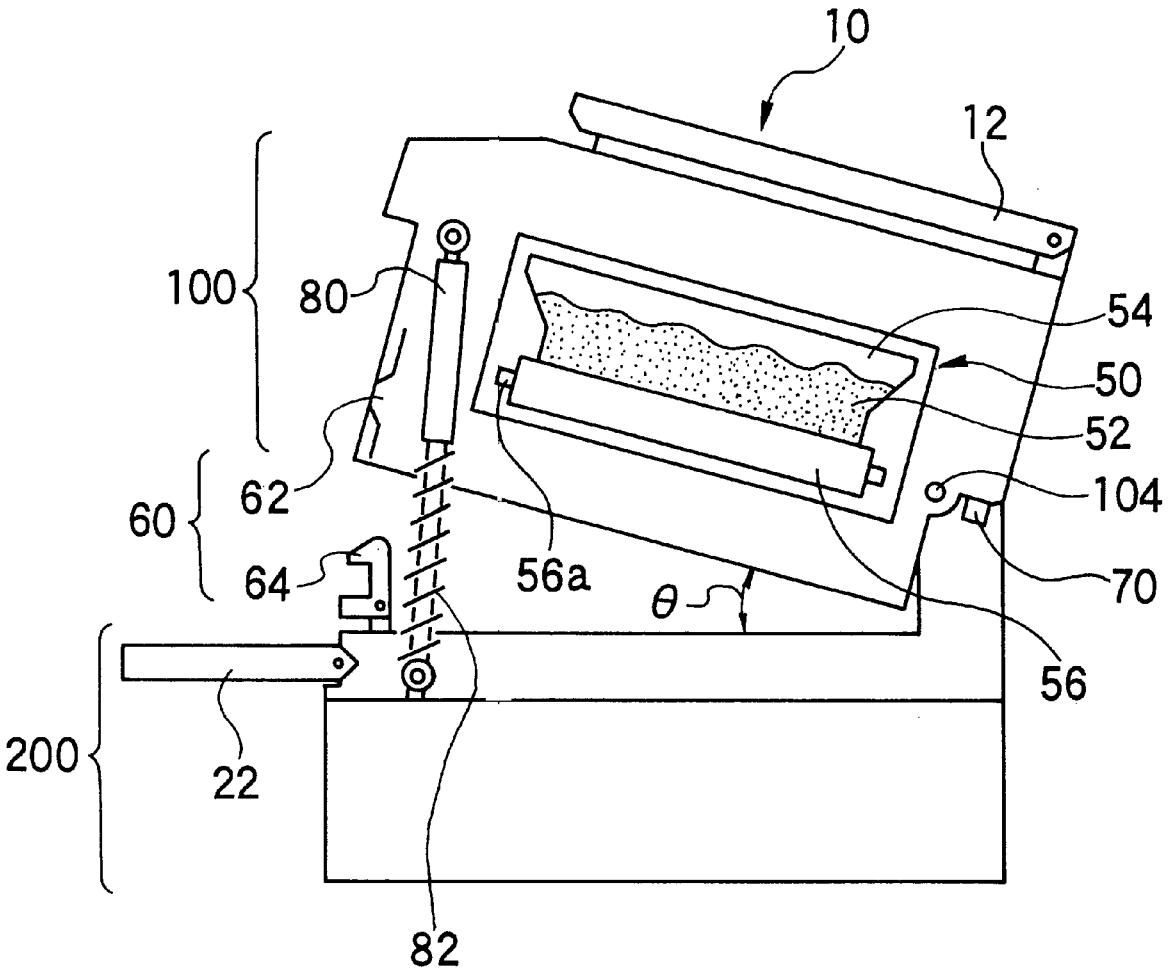
FIG. 3 is a side view showing the copying machine shown in FIG. 1 in a state in which an upper structural body is pushed upward with a front door opened.

A front door 22 which is of a rectangular shape is secured to the front side of the copying machine 10 in such a manner as to be openable frontward by turning the front door 22 around its lower side part 22*a*. Thus, the inside of the copying machine 10 is observable by opening the front door 22. Further, with the front door 22 remaining opened, when a pair of hooks disposed in the neighborhood of the front door 22 are released, as shown in FIG. 3, the front part of an upper structural body 100 (in which an optical system 28, a photosensitive drum 32, etc., shown in FIG. 2 are incorporated), serving as a second casing, of the copying machine 10 is pushed upward by the repulsive force of a pair of dampers 80 (see FIG. 3). With the front part of the upper structural body 100 thus pushed upward, the copying machine 10 is divided into the upper structural body 100 and a lower structural body part 200 (in which the universal cassette 16, etc., are incorporated), as shown in FIG. 3.

Procedures for forming an image with the copying machine 10 shown in FIG. 1 are described below with reference to FIG. 2.

FIG. 2 schematically shows the internal arrangement of the copying machine 10. In FIG. 2, all component elements that are the same as those shown in FIG. 1 are indicated by the same reference numerals as in FIG. 1.

An original-placing glass board 26 is arranged beneath the original pressing plate 12 to have an original 24 placed thereon with an image surface of the original 24 downward. The original 24 is pushed and fixed in place with the original pressing plate 12. An image recorded on the original 24 is read by the optical system 28 which is provided with a known light source lamp (not shown). Then, light which bears information on the image recorded on the original 24 is obtained as shown by a broken line A. The photosensitive drum 32, which is uniformly charged with electricity by a charger 30, is illuminated with the image bearing light to form thereon an electrostatic latent image. The electrostatic latent image is developed into a developed image with a developing agent (toner) which is supplied from a developing device 50. Meanwhile, the recording medium, i.e., recording paper or the like, is sent out from the universal cassette 16 and is fed in the direction of an arrow B. The developed image thus obtained is then transferred to the recording medium at a transfer charger 36.

With the developed image transferred to the recording medium, the recording medium is transported by a transport device 38 to a fixing device 40. At the fixing device 40, the recording medium is transported in a state of being pinched by a heat roller 42 and a press roller 44. In this state, the developed image is fixed to the recording medium. With the developed image thus fixed thereto, the recording medium is delivered and placed on the paper delivery tray 20. Further, after the transfer of the image, residual toner on the photosensitive drum 32 is scraped off the photosensitive drum 32 by means of a cleaning device 46. Incidentally, the recording medium can be fed also from the manual feed tray 18. In this instance, the image is formed on the recording medium fed from the manual feed tray 18 in the same way as the manner described above.

The developing device 50 which is incorporated in the copying machine 10 is described in detail below with reference to FIG. 3.

FIG. 3 is a side view showing the copying machine 10 in a state in which the upper structural body 100 is pushed upward with the front door 22 opened. In FIG. 3, the left side thereof corresponds to the front of the copying machine 10 and the right side thereof corresponds to the rear side of the copying machine 10. In FIG. 3, all the component elements that are the same as those shown in FIGS. 1 and 2 are indicated by the same reference numerals as in FIGS. 1 and 2.

Referring to FIG. 3, the copying machine 10 is of the clamshell-type being divided into the upper structural body 100 and the lower structural body 200, as described above. The upper structural body 100 can be opened and parted from the lower structural body 200 by turning the upper structural body 100 around a hinge 104 which is arranged on the rear side as a turning shaft. The developing device 50 is disposed within the upper structural body 100. The developing device 50 is composed of a developing-agent container 54 containing therein a powdered developing agent 52, and a developing roller 56 arranged to supply the developing agent 52 contained in the developing-agent container 54 to the photosensitive drum 32 (see FIG. 2). The developing roller 56 supplies the developing agent 52 to the photosensitive drum 32 while rotating around a rotating shaft 56*a*, an axial direction of which is perpendicular to (or, intersects with) an axial direction of the turning shaft (the hinge 104) of the upper structural body 100.

The properties of the developing agent 52 are as described below.

The angle of repose of the developing agent 52 is not less than 20° and not more than 65°. In a test conducted, the angle of repose was measured in the following manner.

Measuring device: Powder Tester PT-N (Hosokawa Micron Co., Ltd.); and

Measuring method: In conformity to an angle-of-repose measuring method described in an Instruction Manual annexed to the Powder Tester PT-N.

The conditions for measuring the angle of repose were as follows. A mesh sieve measuring 710 $\mu$m was used, vibration time was 180 sec, and the amplitude was not more than 2 mm. The sample of the developing agent 52 was left intact in an environment of temperature 23° C. and humidity 60% for one night. After that, the angle of repose of the sample was measured with the above-stated measuring device in an environment which also measured 23° C. in temperature and 60% in humidity. The measurement was repeated five times. The angle of repose of the developing agent 52 was decided to be an arithmetic mean of measured values thus obtained. It is to be noted that the angle of repose of the developing agent 52 varies with the temperature and humidity of an environment where the developing agent 52 is used, or with the service condition and service history of the developing agent 52. Generally, the lower the ambient humidity and the newer the developing agent 52, the smaller the angle of repose thereof is.

The developing agent 52 is laid in a flat manner inside the developing-agent container 54, in general. However, the developing agent 52 might be caused to move to gather on one side within the developing-agent container 52 due to an opening and closing operation on the upper structural body 100. Such one-sided gathering of the developing agent 52 causes the supply of the developing agent 52 from the developing roller 56 to the photosensitive drum 32 (see FIG. 2) to become uneven in quantity in the axial direction of the rotating shaft 56*a*. Thus, the behavior of the developing agent 52 in the vicinity of the developing roller 56 occurring due to the rotational driving of the developing roller 56 becomes varied with its positions, so that unevenness of charging and unevenness of coating occur in the layer of the developing agent 52 on the developing roller 56. In that event, since the uniformity of developing is deprived of, there is a possibility that unevenness of density, partial tailed drawing, etc., occur in a developed image. In addition, if the developing agent 52 is gathered extremely on one-side, in the upper portion of the developing roller 56, no layer of the developing agent is formed on the developing roller 56. Then, there is a possibility that the so-called whitening skip-out occurs in a developed image. As a result, the quality of an image thus obtained might be lowered. To avoid the above problem, the copying machine 10 is developed to prevent such a one-sided state of the developing agent 52 in a manner as will be described hereinafter.

A lock hole 62 is formed in the lower part of the front side (on the left side as viewed in FIG. 3) of the upper structural body 100. A hook 64 is mounted on the lower part of the front side (on the left side as viewed in FIG. 3) of the lower structural body 200 and is arranged to fit into the lock hole 62. The lock hole 62 and the hook 64 jointly form a lock mechanism 60 which is arranged to lock the upper structural body 100 and the lower structural body 200 together. When the upper structural body 100 is closed, the hook 64 fits into the lock hole 62 to unify the upper structural body 100 and the lower structural body 200 together.

A stopper 70 is disposed at a lower part on the rear side (on the right side as viewed in FIG. 3) of the upper structural body 100 to make the angle of opening θ (open angle) of the upper structural body 100 constant when the upper structural body 100 has been turned to be opened. This open angle θ is arranged to be 15°±1°.

The dampers 80 are disposed between the upper structural body 100 and the lower structural body 200 to prevent abrupt opening and closing motions of the upper structural body 100. Each of the dampers 80 is provided with a compressed coil spring 82. In opening the upper structural body 100, the lock mechanism 60 is unlocked by releasing the hook 64 from the lock hole 62. With the lock mechanism 60 unlocked, the repulsive force of the dampers 80 acts to cause the upper structural body 100 to open while slowly turning around the turning shaft (hinge) 104 in such a way as to help the user open the upper structural body 100. The turning speed of the upper structural body 100 is slowed by the dampers 80, serving as speed reducing means, in such a way as to prevent the developing agent 52 contained in the developing-agent container 54 from unevenly gathering on one side within the developing-agent container 54. During process of opening and closing the upper structural body 100, vibrations imparted to the developing-agent container 54 are thus mitigated by the dampers 80. In addition, the dampers 80 function also as falling preventing means for preventing the upper structural body 100 from falling in a state where the upper structural body 100 is opened with respect to the lower structural body 200.

With the copying machine 10 arranged in the above-stated manner, in the event of a trouble such as jamming of paper, the upper structural body 100 is made to be opened by unlocking the lock mechanism 60. In that event, the upper structural body 100 is allowed to turn at a low speed as the turning speed of the upper structural body 100 is slowed down by the dampers 80. Therefore, the developing agent 52 contained in the developing-agent container 54 never moves within the developing-agent container 54 to unevenly gather on one side.

The open angle θ of the upper structural body 100 is limited to be 15°±1° by the stopper 70, as mentioned above, even when the upper structure body 100 has been turned to be completely opened. This open angle θ is smaller than the minimum value of 20° of the angle of repose of the developing agent 52. Therefore, the state of the developing agent 52 never collapses to gather on one side within the developing-agent container 54 even when the upper structural body 100 is completely opened.

In closing the upper structural body 100, the user pushes the upper structural body 100 from above. In this instance, the dampers 80 effectively prevent the upper structural body 100 from being too vigorously closed. Therefore, the developing agent 52 contained in the developing-agent container 54 is never disturbed or caused to unevenly gather on one side by vibrations when the upper structural body 100 is closed.

In the copying machine 10, as described above, the developing agent 52 is never disturbed or caused to move to one side within the developing-agent container 54 when the upper structural body 100 is opened and closed. Further, the developing agent 52 never collapses to move to one side within the developing-agent container 54 when the upper structural body 100 is completely opened. As a result, the amount of the developing agent 52 supplied to the photosensitive drum 32 (see FIG. 2) from the developing roller 56 becomes uniform in the axial direction of the rotating shaft 56*a*, so that the image quality can be prevented from being lowered by unevenness of the amount of the developing agent 52 supplied.

Next, a copying machine 110 according to another embodiment of the invention will be described below with reference to FIG. 4.

Figure 4:
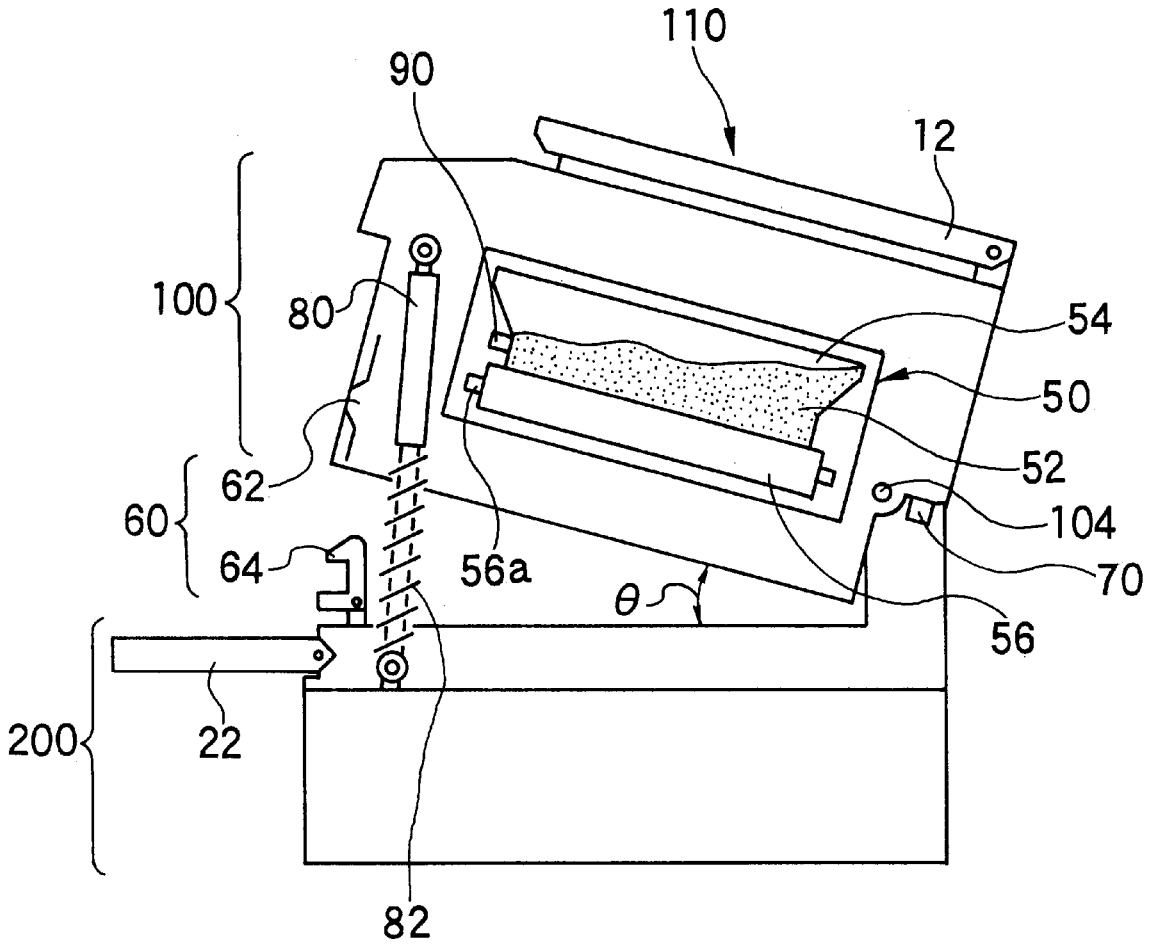
FIG. 4 is a side view showing a copying machine according to another embodiment of the invention in a state in which an upper structural body is pushed upward with a front door opened.

FIG. 4 is a side view showing the copying machine 110 in a state in which the upper structural body 100 is pushed upward with the front door 22 opened. In FIG. 4, the left side thereof corresponds to the front of the copying machine 110 and the right side thereof corresponds to the rear side of the copying machine 110. In FIG. 4, all the component elements that are the same as those shown in FIG. 3 are indicated by the same reference numerals as in FIG. 3.

The copying machine 110 shown in FIG. 4 is characterized in that there is provided a remaining-amount detecting sensor 90 for detecting the remaining amount of the developing agent 52 contained in the developing-agent container 54. The remaining-amount detecting sensor 90 is an example of a remaining-amount detector. The remaining-amount detecting sensor 90 is fixed to that portion of the developing-agent container 54 which is located at an upper position when the upper structural body 100 is opened.

A signal output of the remaining-amount detecting sensor 90 varies according to the amount of the developing agent 52 existing within that area of the developing-agent container 54 which is detectable by the remaining-amount detecting sensor 90. The signal from the remaining-amount detecting sensor 90 is supplied to a control part (not shown) of the copying machine 110. This control part is arranged to let the user know that the remaining amount of the developing agent 52 has become small, for example, by displaying the fact at the operation panel display part 14 (see FIG. 1).

With the copying machine 110 arranged in the above-stated manner, in the event of occurrence of a problem such as jamming of paper, the upper structural body 100 is made to be opened by unlocking the lock mechanism 60. In that event, since the turning speed of the upper structural body 100 is reduced by the dampers 80, the upper structural body 100 is turned at a low speed, so that the developing agent 52 contained in the developing-agent container 54 never moves within the developing-agent container 54 to unevenly gather on one side due to the opening operation of the upper structural body 100.

Assuming that the stopper 70 is arranged to have a full open angle θ of the upper structural body 100 at 25° after completion of turning of the upper structural body 100, the state of the developing agent 52 never collapses to gather on one side within the developing-agent container 54, if the angle of repose of the developing agent 52 is not less than 25°.

In the above-described embodiment, since the remaining-amount detecting sensor 90 is fixed to that portion of the developing-agent container 45 which is arranged to be situated on the upper side when the upper structural body 100 is opened, it is possible to detect, without any delay, that the remaining amount of the developing agent 52 has become small. Therefore, it is possible to prevent the quality of a developed image from lowering.

Further, an example in which the remaining-amount detecting sensor 90 is disposed at that portion of the developing-agent container 54 which becomes an upper side thereof when the upper structural body 100 is opened will be described below in detail.

Figure 5:
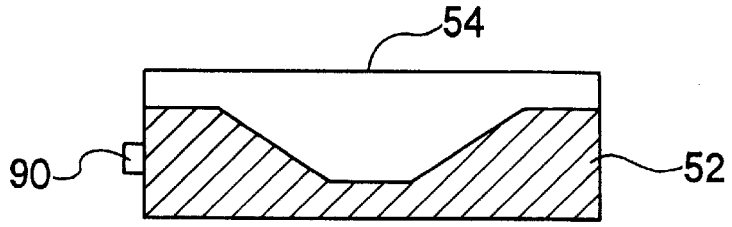
FIGS. 5 to 8 are schematic diagrams showing the manner of movement of a developing agent in a developing device when the upper structural body is opened in a case where the developing agent has been consumed unevenly.
Figure 6:
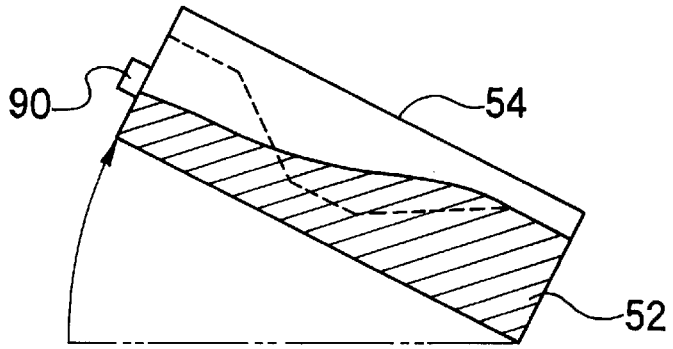
Figure 7:
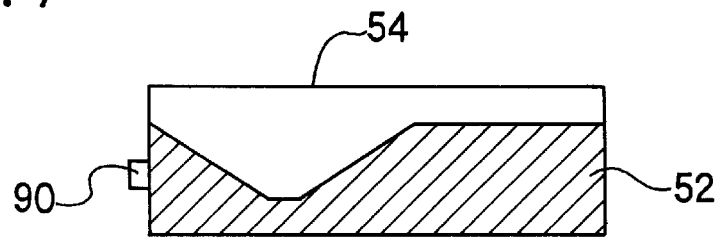
Figure 8:
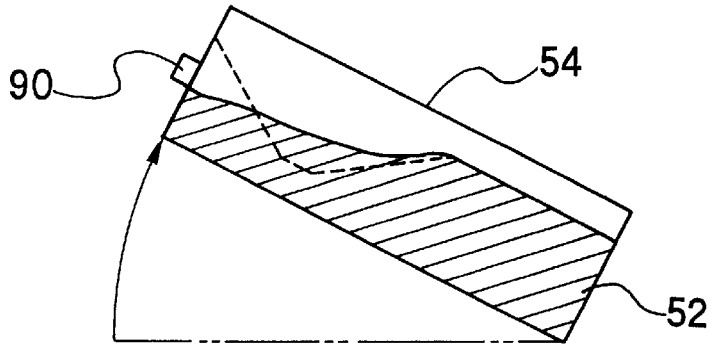

As the remaining-amount detecting sensor 90, a known sensor, such as a piezoelectric element, a magnetic sensor, may be used. It is preferred that the remaining-amount detecting sensor 90 is disposed at that portion of the developing-agent container 54 which becomes an upper side thereof, particularly, at the side surface which becomes an upper side thereof, when the upper structural body 100 is opened. In the copying machine 110 in which the developing device 50 is incorporated according to the present embodiment, in a case where an image forming operation for forming an image having a narrower width than a maximum feedable paper width is continued with the middle of each recording member (paper) set to the middle of the developing roller 56 (for example, a case where papers of B5 size continue to be fed when the maximum feedable paper size of the copying machine 110 is A3), the developing agent 52 is consumed only in a portion thereof corresponding to an area at which the image forming operation is being performed. Therefore, the remainder of the developing agent 52 contained in the developing-agent container 54 is gathered greatly on one-side. Thus, the developing agent 52 contained in the developing-agent container 54 is made to form a recess as shown in FIG. 5 or FIG. 7 according to the angle of repose of the developing agent 52. In such a state, when the upper structural body 100 of the copying machine 110 is opened, a lump of the developing agent 52 above the recess (i.e., on the side near to the remaining-amount detecting sensor 90) is inclined at an angle larger than the angle of repose of the developing agent 52, so that the lump of the developing agent 52 collapses and the developing agent 52 at the upper portion in the developing-agent container 54 is made almost uniform (see FIG. 6 and FIG. 8). Accordingly, even if the developing agent 52 is consumed in a limited range thereof, the operation of opening the upper structural body 100 makes it possible to cause the remaining-amount detecting sensor 90 disposed at the upper portion to detect the degree of consumption of the developing agent 52. As is understandable from FIG. 5 to FIG. 8, the provision of the remaining-amount detecting sensor 90 at the upper portion makes it possible to detect the degree of consumption of the developing agent 52, without moving the developing agent 52 along the rotating shaft 56*a* by means of a stirring mechanism, even if the developing agent 52 is consumed concentrically in any range of the maximum feedable paper width. Therefore, the structural arrangement of the image forming apparatus can be simplified and minimized in size and weight. In addition, it is advantageously possible to prevent a developed image from becoming uneven due to the one-sided state of the layer of the developing agent 52. Incidentally, when it is detected by the remaining-amount detecting sensor 90 that there no developing agent 52 is left, the developing-agent container 54 may be supplied with the developing agent 52.

While, in the above-described embodiments, the copying machine of the electrophotographic type has been described as an example of the image forming apparatus, the invention is, of course, applicable to other apparatuses. For example, if the invention is applied to a facsimile machine of the electrophotographic type, it is possible to prevent the whitening skip-out of an image due to the absence of the developing agent at a portion which becomes an upper side, so that extremely advantageous effects can be obtained.

As the developing agent for use in the above developing device, a one-component magnetic developing agent is preferably used.

If a two-component developing agent is used as the developing agent, there are required, in order to make a mixing ratio of a toner and a carrier of the developing agent constant, a space for mixing and stirring the toner and the carrier, a space for storing the toner only, a device for transporting the toner a little amount at a time from the toner storing space, etc., within the developing device. Therefore, since the required torque for the developing device becomes large, the image forming apparatus becomes complicated in arrangement and large in size. Thus, in the image forming apparatus of the clamshell-type, the weight of the upper structural body to be pushed upward becomes large, and it is necessary to increase the rising-up force of the damper or the like. If the rising-up force of the damper is increased, the bearing portion must have a higher rigidity, thus unfavorably increasing the size and weight of the whole image forming apparatus. Further, since a stronger force is required to close the upper structural body against the damper, a problem arises in point of operability.

On the other hand, in the case of the image forming apparatus using, as the developing agent, a one-component magnetic developing agent, a part of the developing device can be set for a space for containing toner and the stirring mechanism can be simplified as compared with the developing device using the two-component developing agent. Therefore, only a small torque is needed in the developing device, and the weight of the developing device and that of the whole image forming apparatus can be decreased. Thus, in the case of the image forming apparatus of the clamshell-type, since the rising-up force of the damper can be made small, the whole image forming apparatus can be advantageously arranged in small size and in light weight.

What is claimed is:

1. An image forming apparatus comprising:

a first casing;

a second casing turnable around a turning shaft between a closed position in which said second casing is closed with respect to said first casing and an opened position in which said second casing is opened upward with respect to said first casing; and a developing device which develops, with a developing agent, an electrostatic image formed on an image bearing member, said developing device being disposed inside said second casing and comprising a developing-agent bearing member rotatable around a rotating axis to bear and transport said developing agent to a developing position and a developing-agent container containing said developing agent, an axial direction of the rotating axis of said developing-agent bearing member intersecting with an axial direction of the turning shaft of said second casing, wherein an angle by which said second casing is turned from the closed position to the opened position is not more than an angle of repose of said developing agent.

2. An image forming apparatus according to claim 1, wherein said second casing is opened across a recording material convey path with respect to said first casing.

3. An image forming apparatus according to claim 1, wherein said developing device further comprises a detecting member, disposed within said developing-agent container, for detecting an amount of said developing agent, said detecting member being provided adjacent to an upper end portion of both end portions in the axial direction of the rotating axis of said developing-agent bearing member when said second casing is in the opened position.

4. An image forming apparatus according to claim 1, further comprising speed reducing means for reducing a speed at which said second casing is turned from the closed position to the opened position.

5. An image forming apparatus according to claim 1, wherein said speed reducing means is a damper.

6. An image forming apparatus according to claim 1, further comprising falling preventing means for preventing said second casing from falling to the closed position when said second casing is in the opened position.

7. An image forming apparatus according to claim 6, wherein said falling preventing means is a damper.

8. An image forming apparatus according to claim 1, wherein said developing agent is a one-component magnetic developing agent.

9. An image forming apparatus according to claim 1, wherein said image bearing member is provided inside said second casing.

* * * * *